US006689980B2

(12) United States Patent
Sohn

(10) Patent No.: US 6,689,980 B2
(45) Date of Patent: Feb. 10, 2004

(54) CIRCUIT BREAKER HAVING HYBRID ARC EXTINGUISHING FUNCTION

(75) Inventor: Jong Mahn Sohn, Cheongju (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/961,169

(22) Filed: Sep. 24, 2001

(65) Prior Publication Data

US 2002/0036184 A1 Mar. 28, 2002

(30) Foreign Application Priority Data

Sep. 27, 2000 (KR) ..... 2000-56734

(51) Int. Cl.[7] ..... H01H 33/18
(52) U.S. Cl. ..... 218/43; 218/87
(58) Field of Search ..... 218/43–72, 118–140, 218/87

(56) References Cited

U.S. PATENT DOCUMENTS 4,329,551 A * 5/1982 Bernard et al. ..... 218/118
4,511,776 A * 4/1985 Romier et al. ..... 218/43
5,166,483 A * 11/1992 Kersusan et al. ..... 218/71

* cited by examiner

*Primary Examiner*—Lincoln Donovan
(74) *Attorney, Agent, or Firm*—Birch, Stewart, Kolasch & Birch, LLP

(57) ABSTRACT

A circuit breaker having a hybrid arc-extinguishing function includes: an upper shell; a lower shell coupled to the upper shell to form an extinguishing chamber (S) filled with an insulation gas; a movable electrode movably installed at the upper shell and having an exhaust channel for discharging a gas inside the extinguishing chamber (S) outwardly; a fixed electrode having an exhaust channel fixed at the lower shell and positioned at a coaxial line with the movable electrode, through which the gas inside the extinguishing chamber (S) is discharged outwardly, the movable electrode being movable being movable to a position where it contacts with the fixed electrode and to a positioned where it is separated from the fixed electrode; a magnetic coil arranged around the fixed electrode to form a magnetic field for a rotation of an arc, and receiving a conductive current from the movable electrode as being shared with the fixed electrode when the movable electrode is positioned contacting with the fixed electrode; and an arc aligning member made of a cylindrical magnetic material and disposed at the exhaust channel of the fixed electrode to align an arc to a central portion of the fixed electrode in extinguishing the arc, and having a varying inner diameter to quickly extinguish the arc.

16 Claims, 9 Drawing Sheets

CIRCUIT BREAKER HAVING HYBRID ARC EXTINGUISHING FUNCTION

BACKGROUND OF THE INVENTION

1. Field of the Invention

The present invention relates to a circuit breaker having a hybrid arc extinguishing function, and more particularly, to a circuit breaker having a hybrid arc extinguishing function that is capable of improving an arc extinguishing characteristic by promptly extinguishing an arc, increasing a conduction capacity, with a simple structure and compact size.

2. Description of the Background Art

In general, a circuit breaker is an electric protection instrument installed between an electrical power source and an electrical load for a function of protecting the load instrument and a cable from a possible incident current (a large current due to an incident such as a short or a ground fault) generated in an electric circuit, for a circuit switching and for a distribution function for switching a power supply to a different cable.

As for a currently used high voltage circuit breaker, $SF_6$ is mostly used as an insulation medium, and a vacuum interrupter is mostly used as an arc extinguisher.

The vacuum interrupter is an arc extinguisher which is mostly used for a high voltage circuit breaker. In spite of its excellent functional aspect, it is expensive, and since vacuum is used as an arc extinguishing medium, high switching surge occurs.

Since the insulation medium employs the $SF_6$ gas and the arc-extinguishing medium is a vacuum, it is disadvantageous in the aspect of an expense.

Accordingly, a high pressure arc-extinguishing function which would use the same $SF_6$ gas for the insulation medium and the arc-extinguishing medium but has the same function as the vacuum interrupter is required to be developed.

And in order to meet the requirement, a rotary arc type arc-extinguishing function has been developed. It is easily fabricated, its price is relatively low, and a switching surge does not occur.

The rotary arc type arc-extinguishing function has an advantage that, when an arc is generated between a fixed contactor and a movable contactor, an arc current flows in a magnetic coil and the arc is rotated by a magnetic flux generated from the magnetic coil, so that there is not much damage to an arc contactor and its structure can be simplified.

However, the rotary arc type arc-extinguishing function has the following problems. That is, in case of breaking a small current, the small current flows to the magnetic coil, failing to generate a sufficient driving magnetic flux, so that it is hard to break the small current. In addition, since only a cooling method according to an arc rotation is adopted, in case that a breaking capacity is increased, the size of a breaking portion and its stroke are increased, resulting in that there is a restriction to heightening of a breaking capacity.

In an effort to remove the shortcomings of the rotary arc type (method), a research on a hybrid arc-extinguishing function using more than two arc-extinguishing principles is being actively conducted.

That is, a hybrid arc-extinguishing function is being developed by uniting the rotary arc type (method) for cooling by rotating an arc and a heat expansion arc-extinguishing method in which, when an arc is generated, an internal pressure raised by heat expansion of an insulation medium is used to extinguish the arc.

FIG. 1 is a vertical sectional view of a hybrid arc-distinguishing function of a circuit breaker in accordance with a conventional art.

The conventional art of FIG. 1 can refer to U.S. Pat. No. 5,166,483.

A circuit breaker having the hybrid arc-extinguishing function of the conventional art has an upper shell and a lower shell 111 and 112 which forms an extinguishing chamber (S) filled with an insulation medium such as $SF_6$ gas, a fixed electrode 131 having a fixed contactor 132 at an upper end fixed at the lower shell 112, a movable electrode 141 disposed to be linearly movable at the upper shell 111 and having a movable contactor 136 which is conducted by being contacted with the fixed contactor 132, and a magnetic coil 147 disposed around the fixed electrode 131 and forming a magnetic field to rotate an arc generated when the fixed contractor 132 and the movable contractor 136 are separated.

The above-described hybrid arc-extinguishing function for a circuit breaker is adopted to a three-phase circuit breaker, and since the three phases have the same form, one of which, thus, will now be described.

The upper shell 111 and the lower shell 112 are inserted in a sealed case (not shown), and mutually coupled to be square. A guide sleeve 113 for guiding the movable electrode 141 so as to be linearly movable is coupled at an upper face of the upper shell 111, and a fixing hole 124 is formed at a lower face of the lower shell 112, into which the fixed electrode 131 fixedly penetrates. A rectangular shielding member 145 is coupled along the inner wall face forming the extinguishing chamber (S).

The guide sleeve 113 penetrates in a manner that the movable electrode 141 is movable centering around a shaft, and a seal 115 is mounted at the inner face for sealing with the movable electrode 141 which is linearly moved. A retainer 117 is engaged at an upper side of the seal 115 to prevent the seal 115 from releasing.

In the fixed electrode 131, in order to discharge $SF_6$, gas filled in the extinguishjing chamber (S), an exhaust channel 126 communicating with inside of the case (not shown) is axially formed, and an arc aligning cylinder 137 made of a magnetic material is installed isolated from the upper end.

A magnetic coil 147 forming a magnetic field to rotate an arc to surround the outer circumferential face of the cylinder 137 and the outer circumferential face of the fixed electrode 131.

The movable electrode 141 includes a cylinder 134 disposed to be slid to the guide sleeve 113 and having an exhaust channel 142 axially formed for discharging SF6 gas, a movable contactor 136 slidably inserted at a lower end of the cylinder 134 and contacting with the fixed contactor 132, and a pressure spring 138 disposed between the movable contactor 136 and the cylinder 134, for maintaining a contact pressure when the movable contactor 136 contacts with the fixed contactor 132.

The movable electrode is driven by an external mechanical actuator(not shown).

In the circuit breaker having the hybrid arc-extinguishing function of the conventional art constructed as described above, the movable electrode 141 is separated from the fixed electrode 131 as it is slid upwardly according to an operation of the external mechanical actuator.

At this time, an arc formed between the fixed contractor 132 and the movable contractor 136 is rotated within the extinguishing chamber (S) by the magnetic filed formed by the magnetic coil 147, and according to the rotation of the arc, the neighboring $SF_6$ gas is rotated up to the shield plate 145. As the arc is formed, a temperature inside the extinguishing chamber (S) goes up, and accordingly, the internal pressure is increased.

As the pressure in the extinguishing chamber (S) is increased and the $SF_6$ gas is rotated, the gas inside the extinguishing chamber (S) is discharged outwardly through the exhaust channels 142 and 125 respectively formed at the movable electrode 141 and the fixed electrode 131.

In this manner, the arc is rotated by the magnetic field, and at the same time, cooling is accelerated by the flow of the $SF_6$ gas according to the change of the pressure, so that the arc is quickly extinguished relatively.

When the external mechanical actuator is operated to move the movable electrode 141 downwardly for conduction, the movable contactor 136 is closed up the fixed contactor 132 to form a closed circuit.

At this time, an electron repulsive force is formed between the fixed contactor 132 and the movable contactor 136. By allowing the pressure spring 138 to give an elastic force to the movable contactor 136, the tightening force with the fixed contactor 132 can be maintained.

However, the circuit breaker having the hybrid arc-extinguishing function in accordance with the conventional art has many problems.

That is, for example, first, the inner wall face of the cylinder for aligning the arc in a state that the conductive current becomes zero when a circuit is broken, has a flat linear form, failing to quickly induce the arc into the exhaust channel.

Secondly, when the movable contactor contacts with the fixed contactor, the conductive current flows from the movable contactor through the fixed contactor then through the coil and to the fixed electrode.

That is, in view of its structure, the conductive current all flows through the magnetic coil. Thus, in order to increase the conduction capacity, the winding number and/or size of the magnetic coil should be increased, resulting in that the size of the breaker is inevitably increased.

In this respect, if the winding number of the magnetic coil is constant and only its dimension becomes larger, the magnetic flux amount for controlling and rotating the arc is reduced, so that the circuit breaking operation is not properly performed.

If, however, the winding number of the magnetic coil is increased to increase the magnetic flux amount and to increase the conduction capacity, since the whole size of the magnetic coil is increased, resulting in that the magnetic flux amount is reduced due to the increase of the magnetic resistance. Thus, there is a limitation to the increase of the conduction capacity.

In addition, when the movable electrode and the fixed electrode are contacted, the electromagnetic repulsive force generated between the fixed contactor and the movable contactor works to push upwardly the movable contactor. Thus, in order to maintain the tightening force between the fixed contactor and the movable contactor, a pressure spring having a relatively strong elastic force should be installed in the hybrid arc-extinguishing function, which makes the size of the external mechanical actuator for driving the movable contactor to be relatively larger.

SUMMARY OF THE INVENTION

Therefore, an object of the present invention is to provide a circuit breaker having a hybrid arc-extinguishing function in which an arc aligning unit and a fixed contactor are provided in a magnetic coil so that, when an arc-extinguishing operation, the arc aligning unit can align the arc to a central portion of a fixed electrode in the vicinity of a current zero point, to thereby increase an arc-extinguishing characteristic.

Another object of the present invention is to provide a circuit breaker having a hybrid arc-extinguishing function that is capable of increasing a conduction capacity without increasing the winding number of a magnetic coil and the size of the magnetic coil in such a manner that a main conductive current flows through a conduction path separately prepared in addition to the magnetic coil so that the conductive current flows separately from the magnetic coil.

Still another object of the present invention is to provide a compact-sized circuit breaker having a hybrid arc-extinguishing function with a simple structure which does not need an additional component for maintaining a pressure, for which a movable electrode is fabricated with a structure having a certain elastic force in itself so that when the movable electrode is inserted into a fixed electrode, a contact pressure is applied to the movable electrode to maintain a contact force therebetween.

To achieve these and other advantages and in accordance with the purpose of the present invention, as embodied and broadly described herein, there is provided a circuit breaker having a hybrid arc-extinguishing function including: an upper shell; a lower shell coupled to the upper shell to form an extinguishing chamber (S) filled with an insulation gas; a movable electrode movably installed at the upper shell and having an exhaust channel for discharging a gas inside the extinguishing chamber (S) outwardly; a fixed electrode having an exhaust channel fixed at the lower shell and positioned at a coaxial line with the movable electrode, through which the gas inside the extinguishing chamber (S) is discharged outwardly, the movable electrode being movable being movable to a position where it contacts with the fixed electrode and to a positioned where it is separated from the fixed electrode; a magnetic coil arranged around the fixed electrode to form a magnetic field for a rotation of an arc, and receiving a conductive current from the movable electrode as being shared with the fixed electrode when the movable electrode is positioned contacting with the fixed electrode; and an arc aligning member made of a cylindrical magnetic material and disposed at the exhaust channel of the fixed electrode to align an arc to a central portion of the fixed electrode in extinguishing the arc, and having a varying inner diameter to quickly extinguish the arc.

In the circuit breaker having a hybrid arc-extinguishing function of the present invention, the upper shell and the lower shell are mutually coupled to form a rectangular extinguishing chamber (S), partitions are formed to divide the extinguishing chamber (S) into three portions corresponding to each of three phases therein, a guide sleeve at which the movable electrode is slidably disposed is integrally formed at the upper face of the upper shell, and a fixing hole is formed at the lower face of the lower shell, through which the fixed electrode penetratingly fixed.

In the circuit breaker having a hybrid arc-extinguishing function of the present invention, the arc aligning member has a hollow cylinder form which is inserted into an exhaust channel of the fixed electrode to discharge the gas of the extinguishing chamber outwardly, and includes an arc aligning portion with an upper inner circumferential surface formed to be slanted at a predetermined angle toward the center of the inner diameter to converge an arc.

In the circuit breaker having a hybrid arc-extinguishing function of the present invention, the arc aligning member includes a cylindrical body portion inserted into the exhaust channel of the fixed electrode, a neck portion extended with a reduced diameter from the upper end of the body portion, and an arc aligning portion formed in a manner that the inner circumferential surface of the neck portion is slanted inwardly.

To achieve the above objects, there is also provided a circuit breaker having a hybrid arc-extinguishing function including: an upper shell and a lower shell forming an extinguishing chamber (S) filled with an insulation gas; a magnetic coil inserted in the extinguishing chamber to provide a magnetic field for rotation of an arc; a movable electrode slidably disposed at the upper shell, and dividing a conduction path into a movable arc contactor member and a movable main contactor so that a conductive current flows as being divided in a predetermined ratio; a fixed arc contactor member being fixed at the lower shell so as to be positioned on the coaxial line with the movable electrode, and being contact with the movable arc contactor member to form a conduction path; and a fixed electrode being contacted with the movable main contactor and electrically connected to the magnetic coil so as to share the conductive current flowing from the movable electrode with the conduction path in a predetermined ratio and render it to flow toward the magnetic coil.

In the circuit breaker having a hybrid arc-extinguishing function of the present invention, the movable electrode includes a movable electrode body slidably inserted into the upper shell; a movable arc contactor member coupled to the lower end of the movable electrode body and contacted with the fixed arc contactor member to form a conduction path; and a stopper extended outwardly from one side of the movable electrode body to restrict a vertical stroke of the movable electrode body and having a movable main contactor contacted with the fixed main contactor to serve as a conduction path at the lower face.

In the circuit breaker having a hybrid arc-extinguishing function of the present invention, the movable arc contactor member is integrally coupled at the lower end of the movable electrode body, and a movable arc contactor is formed with an end portion processed to be round, at an outer circumferential surface of which a conductive current flows.

In the circuit breaker having a hybrid arc-extinguishing function of the present invention, the stopper includes an engaging seat engaged with the upper shell at the upper surface to limit an up stroke of the movable electrode, and a movable main contactor for limiting a down stroke of the movable electrode, and being contacted with the fixed main contactor of the fixed electrode so as for the conductive current to flow.

In the circuit breaker having a hybrid arc-extinguishing function of the present invention, the fixed electrode includes a fixed electrode body fixed at the fixing hole of the lower shell and having an exhaust channel therein; a fixed arc contact point member fixed at the exhaust path of the fixed electrode body and contacted with the movable arc contactor member to form a main conduction path; and a fixed main contactor fixed at the upper face of the magnetic coil and contacted with the movable main contact point so as for the conductive current to flow toward the magnetic coil.

In the circuit breaker having a hybrid arc-extinguishing function of the present invention, the fixed arc contactor member has a cylinder form to be inserted into the fixed electrode body and includes an elasticity providing portion for applying an elastic force in the vertical direction to the axis so that a contact pressure is applied when the movable electrode is contacted and the movable electrode is prevented from releasing by an electromagnetic repulsive force, and a fixed arc contactor formed at the upper end with which the movable arc contactor contacts In the circuit breaker having a hybrid arc-extinguishing function of the present invention, the fixed main contact point is disposed at an upper side of the magnetic coil and made of a conductive material in an annular form so as to be conducted by being contacted with the movable contactor, and slits are radially formed at certain intervals at the front face thereof.

In the circuit breaker having a hybrid arc-extinguishing function of the present invention, the magnetic coil includes: a coil supporter stacked to surround the outer circumferential surface of the fixed arc contactor member; an insulation material disposed between the magnetic coils; and a coil supporter is installed to electrically connected the magnetic coils.

To achieve the above objects, there is further provided a circuit breaker having the hybrid arc-extinguishing function including: an upper shell and a lower shell mutually coupled to form an extinguishing chamber (S) filled with an insulation gas; a magnetic coil inserted in the extinguishing chamber to provide a magnetic field for rotation of an arc; a movable electrode slidably disposed at the upper shell, and dividing a conduction path into a movable arc contactor member and a movable main contactor so that a conductive current flows as being divided in a predetermined ratio; a fixed arc contact point member being fixed at the lower shell so as to be positioned on the coaxial line with the movable electrode, and being contact with the movable arc contactor member to form a conduction path; a fixed electrode being contacted with the movable main contactor and electrically connected to the magnetic coil so as to share the conductive current flowing from the movable electrode with the conduction path and render it to flow toward the magnetic coil; and an arc aligning member disposed at an inner circumferential surface of the fixed electrode to align an arc to the central portion of the fixed electrode in extinguishing the arc and having a magnetic material with a varying inner diameter to quickly extinguish the arc.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a circuit breaker having the hybrid arc-extinguishing function of the present invention, and the most preferred embodiment will now be described.

Figure 1:
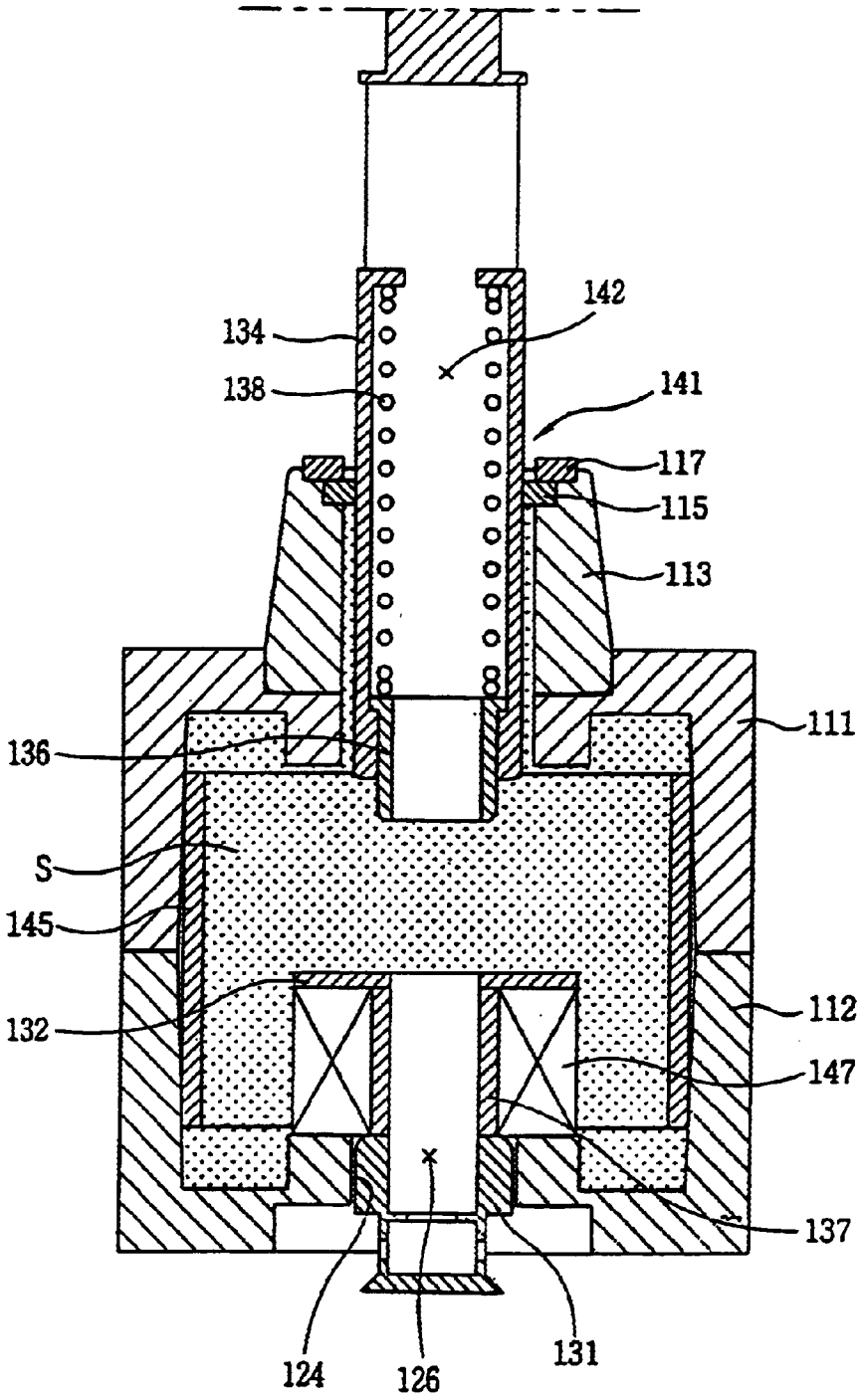
FIG. 1 CONVENTIONAL ART
FIG. 1 is a schematic vertical-sectional view showing a major part of a circuit breaker having a hybrid arc-extinguishing function in accordance with a conventional art.
Figure 2:
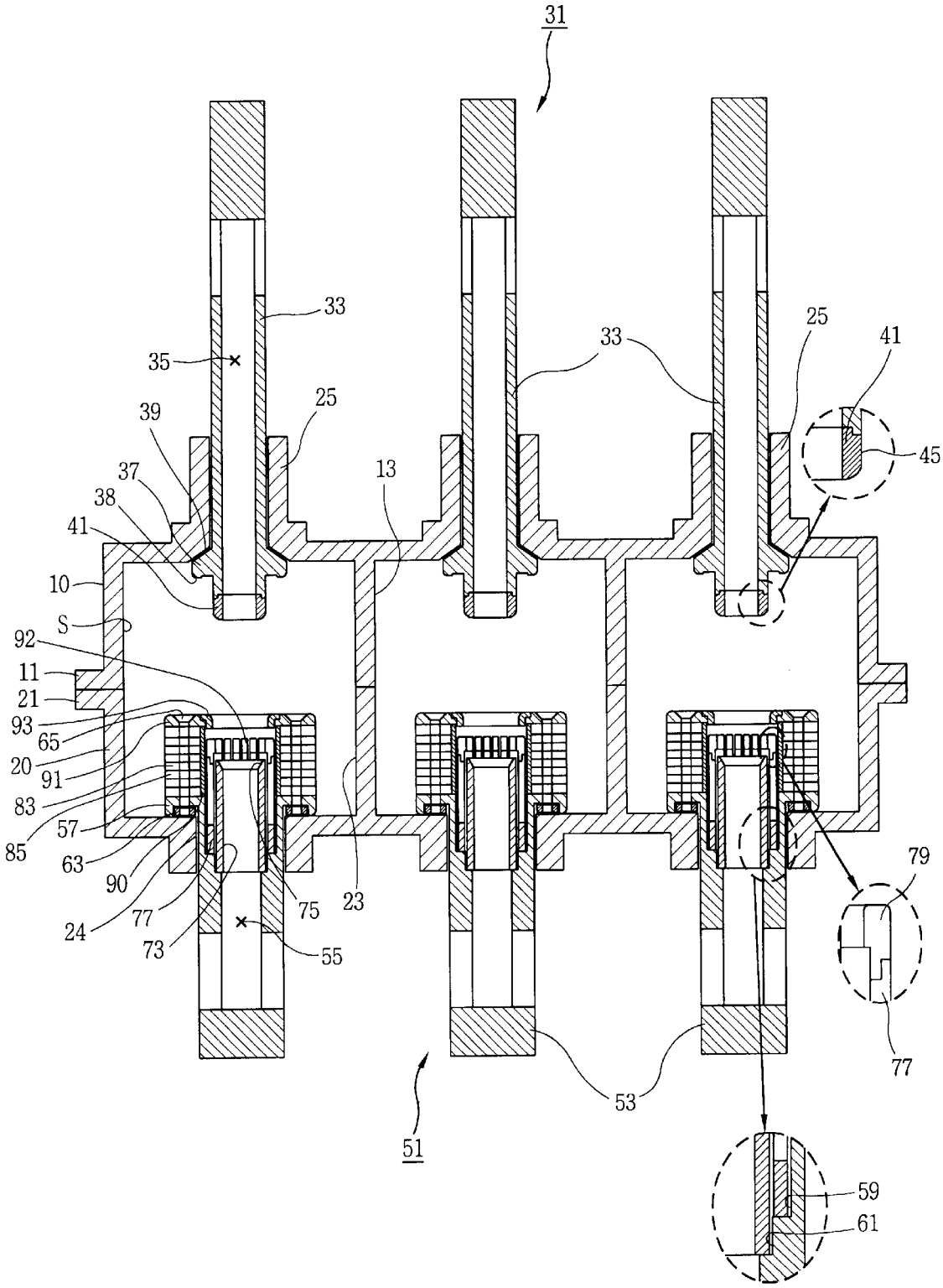
FIG. 2 is a vertical-sectional view showing a major part of a circuit breaker having a hybrid arc-extinguishing function in accordance with one embodiment of the present invention.

FIG. 2 is a vertical-sectional view showing a major part of a circuit breaker having a hybrid arc-extinguishing function in accordance with one embodiment of the present invention.

A circuit breaker having a hybrid arc-extinguishing function includes an upper shell 10 and a lower shell 20 which are coupled to be sealed and form an extinguishing chamber (S) in which an electric insulation gas is filled, a movable electrode 31 slidably disposed at the upper shell 10, a fixed electrode 51 fixed at the lower shell 20 and positioned at a coaxial line with the movable electrode 31, and a magnetic coil 83 disposed at an outer circumferential surface of the fixed electrode 51, for providing a magnetic field for an arc rotation.

The upper shell and the lower shell 20 are coupled to form a rectangular extinguishing chamber (S), and flanges 11 and 21 are formed at the coupled face and bolt-engaged.

There are partitions 13 and 23 for dividing the extinguishing chamber (S) so as to correspond to each of 3 phases therein.

A guide sleeve 25 is integrally formed at the upper side of the upper shell 10 in which the movable electrode 31 is slidably disposed.

A fixing hole 24 is formed at the lower side of the lower shell 20 in which the fixed electrode 51 is penetratingly fixed.

As an insulation medium filled in the extinguishing chamber (S), $SF_6$ gas is preferably used.

Figure 3:
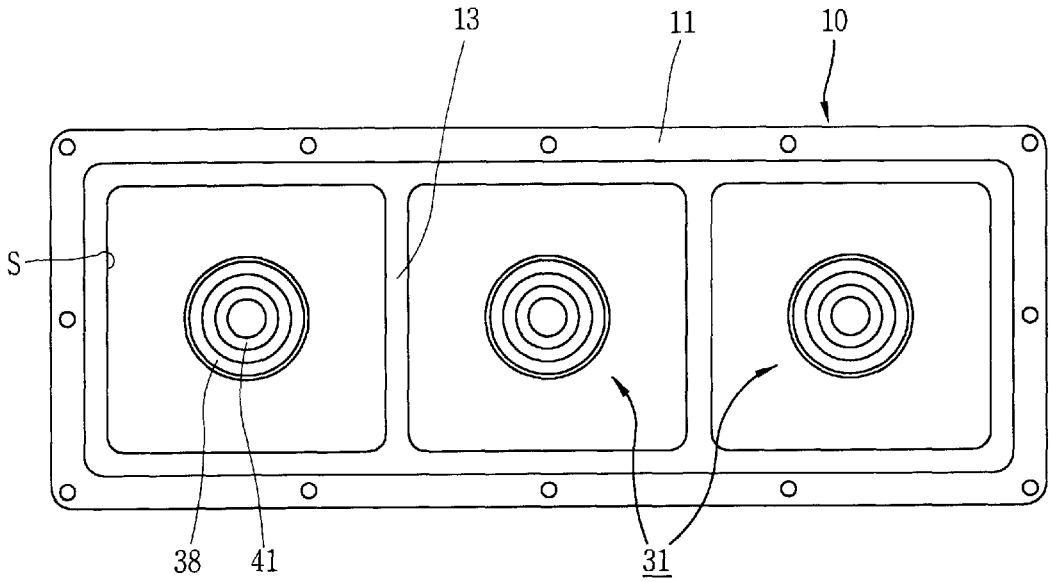
FIG. 3 is a plan view showing a movable electrode of the circuit breaker in accordance with a preferred embodiment of the present invention.
Figure 4:
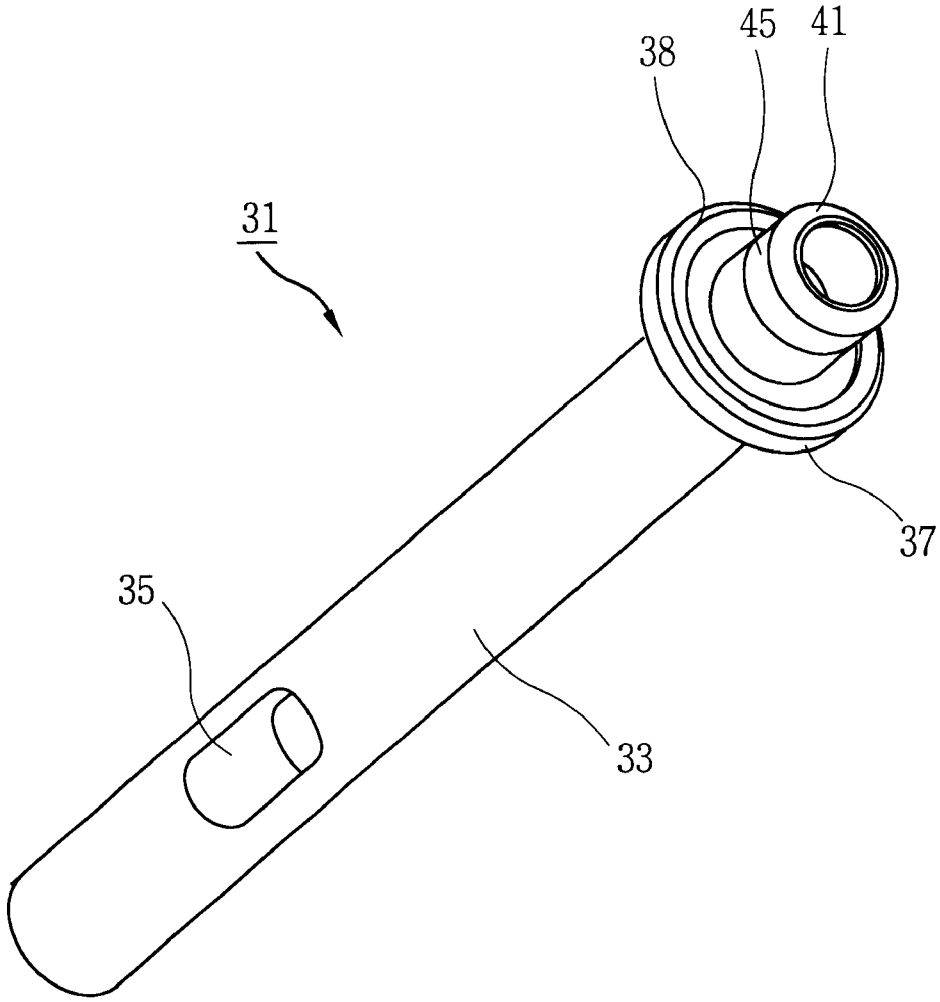
FIG. 4 is a perspective view showing a movable electrode of the circuit breaker in accordance with the preferred embodiment of the present invention.

FIG. 3 is a plan view showing a movable electrode of the circuit breaker in accordance with a preferred embodiment of the present invention.

The movable electrode 31 includes a movable electrode body 33 slidably inserted in the guide sleeve 25 formed at the upper shell 10 and driven by an external mechanical actuator, a movable arc contactor member 41 coupled at a lower end of the movable electrode body 33, and a stopper 37 extended from one side of the movable electrode body 33 to prevent the movable electrode body 33 from releasing from the upper shell 10, and serving as a conduction path.

In the movable electrode body 33, an exhaust channel 35 for discharging an arc gas filled in the extinguishing chamber (S) in an arc operation is formed in an axial direction (a vertical direction).

The movable arc contactor member 41 is made of an arc-resistance material and integrally coupled at a lower end of the movable electrode body 33, and a movable arc contact point 45 is formed with its end portion processed to be round in the circumference direction and a conductive current flows on the outer circumferential surface thereof.

The stopper 37 includes an engaging seat 39 with its upper face slanted at a certain angle so as to be engaged with the inner circumferential surface of the sleeve guide 25 and a movable main contactor 38 with its lower face serving as a stopper by being engaged with an upper face of the fixed electrode 51 and restricting the movable electrode 31 from lowering down for a predetermined degree when the movable electrode 31 is lowered down, being contacted with the fixed electrode 51 so that a conductive current flows.

In the movable electrode 31, the conductive current is divided in a predetermined ratio to be conducted through the movable arc contactor 45 and the movable main contactor 38.

Figure 5:
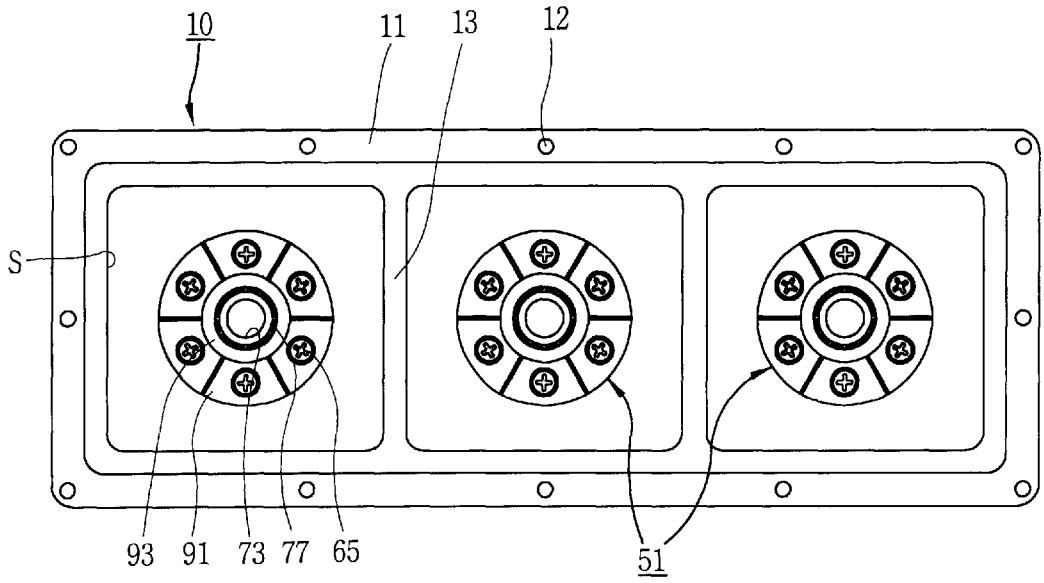
FIG. 5 is a plan view showing a fixed electrode of the circuit breaker in accordance with the preferred embodiment of the present invention.
Figure 6:
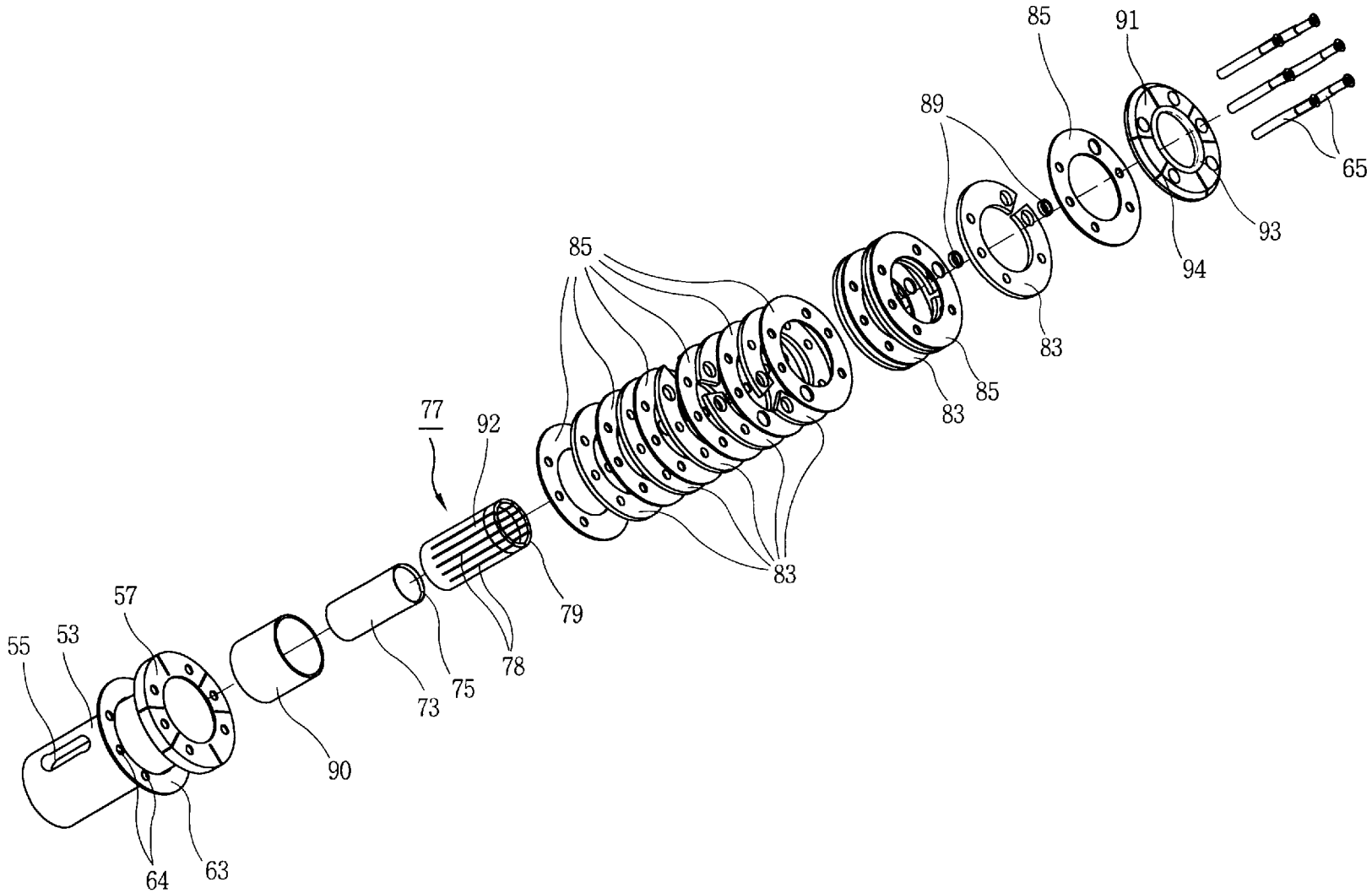
FIG. 6 is an exploded perspective view of the fixed electrode and the magnetic coil of the circuit breaker in accordance with the preferred embodiment of the present invention.
Figure 7:
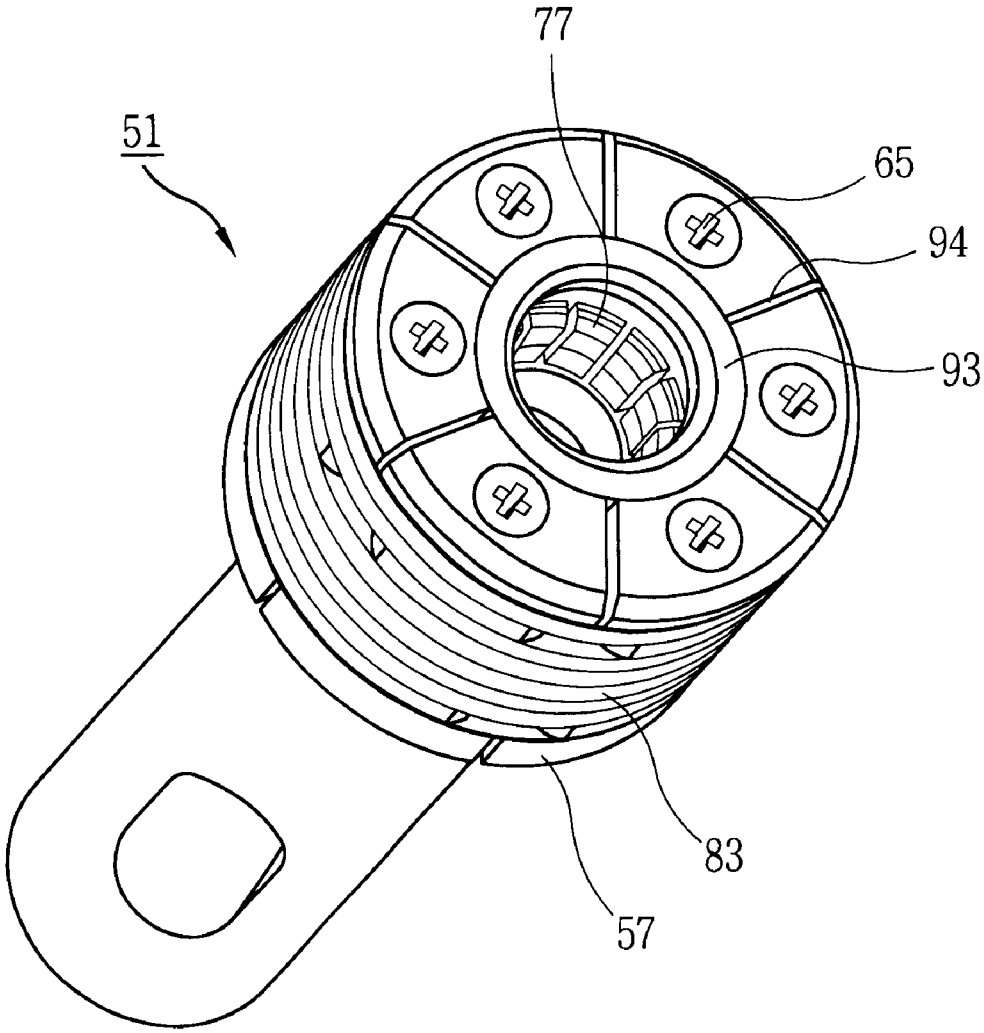
FIG. 7 is a perspective view showing a structure of how the fixed electrode and the magnetic coil of the circuit breaker are coupled in accordance with the preferred embodiment of the present invention.
Figure 8:
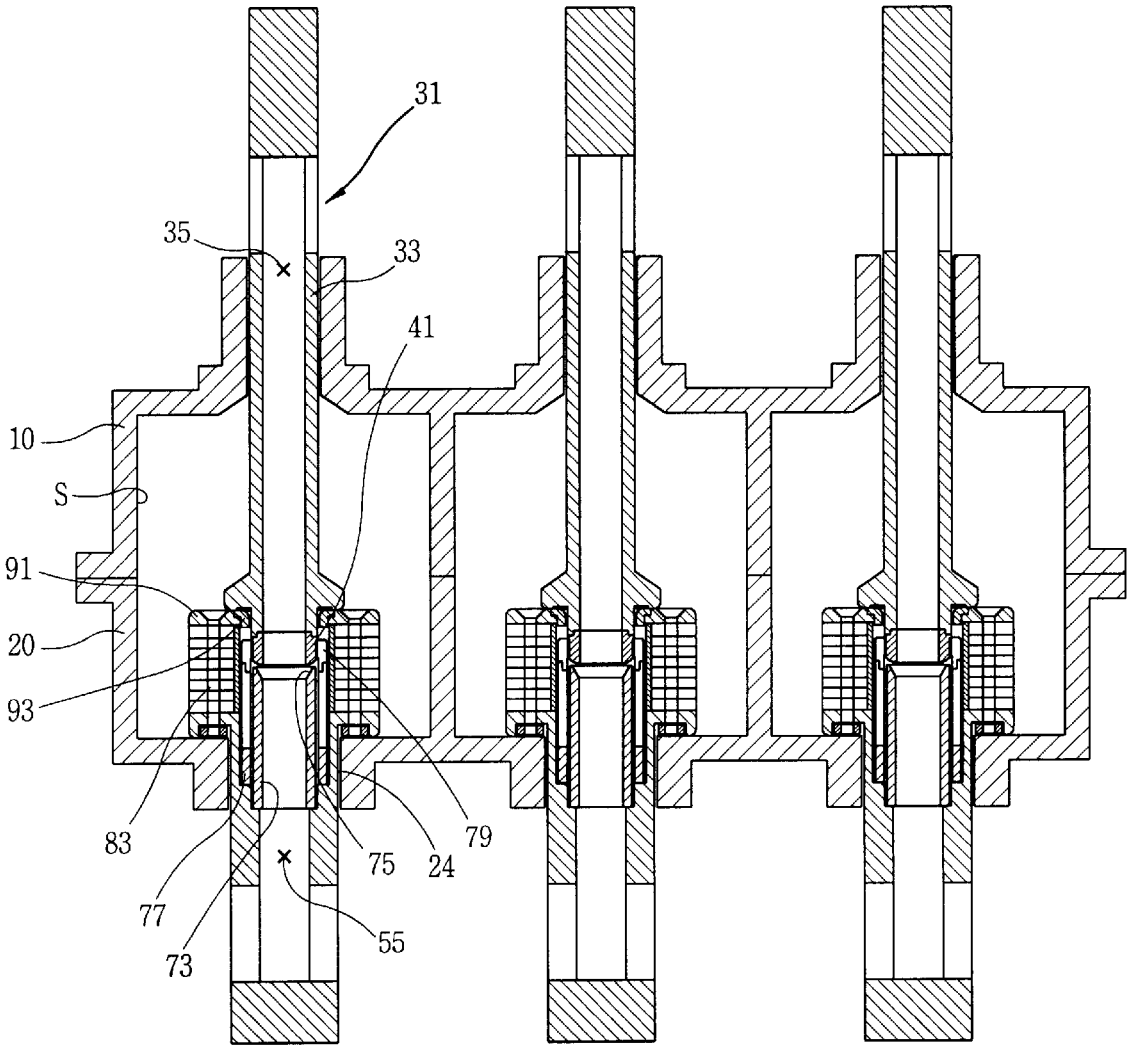
FIG. 8 is a view illustrating an operational state of the circuit breaker having a hybrid arc-extinguishing function in accordance with the preferred embodiment of the present invention.

FIG. 5 is a plan view showing a fixed electrode of the circuit breaker in accordance with the preferred embodiment of the present invention, FIG. 6 is an exploded perspective view of the fixed electrode and the magnetic coil of the circuit breaker in accordance with the preferred embodiment of the present invention, and FIG. 7 is a perspective view showing a structure of how the fixed electrode and the magnetic coil of the circuit breaker are coupled in accordance with the preferred embodiment of the present invention.

The fixed electrode 51 includes a fixed electrode body 53 fixed at the fixed hole 24 of the lower shell, a fixed arc contactor member 77 inserted into the fixed electrode body 53 in which the movable arc contactor member 41 is inserted so as to be electrically connected to each other and providing an elastic force for preventing the movable arc contactor member 41 from releasing when the movable arc contactor member 41 is inserted, and a fixed main contactor 91 fixed at the upper face of the magnetic coil 83, so as to be contacted with or separated from the movable main contactor 38.

An arc aligning member 73 in a hollow cylinder form with a varying diameter is disposed at the inner circumferential surface of the fixed arc contactor member 77 so as to align the arc to the central portion of the fixed electrode 51 and quickly extinguishing the arc in a state that a conductive current becomes zero in breaking a circuit.

The fixed electrode body 53 includes an exhaust channel 55 formed in the axial direction for exhausting an arc gas inside the extinguishing chamber (S), and a flange 63 engaged inside the fixing hole 24 is formed at an upper end thereof to prevent the fixed electrode body 53 from releasing from the lower shell 20.

The flange 63 is coupled to the lower shell 20 by a flange member 57 by bolt.

On the exhaust channel 55, a first insertion recess 59 is formed in a step form into which the fixed arc contactor member 77 is insertedly fixed, and a second insertion recess 61 is formed in a step form into which the arc aligning member 72 is insertedly fixed, respectively.

The fixed arc contactor member 77 is made of a chrome copper material in a cylindrical form fixed in the first insertion recess 59, a fixed arc contactor 79 conducted by being contacted with the movable arc contactor 45 is fixed at the end portion, and an elasticity providing portion 78 is formed to maintain a contact state by providing an elasticity in the vertical direction to the longitudinal direction to prevent the movable arc contactor member 41 from releasing when the movable arc contactor member 41.

The elasticity providing portion 78 includes a plurality of fingers 92 formed by being divided into a plurality of slits at the upper portion of the fixed arc contactor member 77, so that, when the movable arc contactor member 41 is inserted into the fixed arc contactor member 77, the fingers are widened outwardly to provide an elastic restoration force, thereby preventing the movable arc contactor member 41 and the fixed arc contactor member 77 from separating each other due to the electromagnetic repulsive force.

When the movable arc contactor member 41 is inserted, the fixed arc contactor member 77 is widened outwardly to provide a contact pressure to the movable arc contactor member 41, and as the fixed arc contactor 79 contacts with the movable arc contactor 45, a conduction is made.

The arc aligning member 73 has a hollow cylinder form with both end portions opened in the longitudinal direction so as to exhaust the arc gas filled in the extinguishing chamber (S), is fixed at the inner circumferential surface of the fixed arc contactor member 77 and made of a magnetic material, and includes an arc aligning portion 75 is formed at the upper inner circumferential surface, which is slanted at a predetermined angle toward a center of the inner diameter at which the inner diameter is varying so that the arc can be converged.

The magnetic coil 83 includes a plurality of annular conductive members with a portion opened and stacked to be installed surrounding the outer circumferential surface of the fixed arc contactor member 77.

An insulation material 85 is disposed between each pair of the magnetic coils 83 to electrically insulate them, and a coil supporter 89 made of conductive material electrically connects each pair of the magnetic coils 83 by penetrating the insulation material 85.

A hollow cylindrical insulation member 90 with both end portions opened in the longitudinal direction for electrically insulating the magnetic coil 83 and the fixed arc contactor member 77 is inserted at the inner circumferential surface of the magnetic coil 83.

A plurality of bolts 65 penetrates the stacked plurality of magnetic coils 83 in the vertical direction, and the bolts 65 are coupled to the flange 63 of the fixed electrode to fix the magnetic coil 83 to the fixed electrode 53.

The fixed main contactor 91 is disposed at the upper side of the magnetic coil 83 and made of an annular conductive material which is conducted by being contacted with the movable main contactor 41, and an arc runner 93 is fixed at the inner circumferential surface thereof.

At the front surface, slits 94 are radially formed at regular intervals, and engaged at the upper surface of the magnetic coil 83 by the bolt 65 for fixing the magnetic coil 83.

The operation of the circuit breaker having a hybrid arc-extinguishing function constructed as described above will now be explained.

When an additional actuator (not shown) is operated for a conduction and lowers down the movable electrode 31, the movable arc contactor member 41 is inserted into the fixed arc contactor member 77, so that the movable arc contactor 45 is contacted with the fixed arc contactor 79 to form a cable of a conductive current.

When the movable arc contact point member 41 is inserted into the fixed arc contactor member 77 and the fixed arc contactor member 77 is elastically widened outwardly, an elastic force is applied to the fixed arc contactor 79 so that it is maintained in the contact state. In this respect, since the end portion of the movable arc contactor member 41 is formed round, the movable arc contactor member 41 is easily inserted into the fixed arc contactor member 77.

When the movable electrode body 33 is lowered down further, the movable main contactor 38 is contacted with the fixed main contactor 91 to form a second conduction path and the movable main contactor 38 is engaged with the fixed main contactor 91, so that the movable electrode body 33 is restricted from lowering down any further.

In this manner, when the movable arc contactor 45 and the fixed arc contactor 79 are contacted with each other, the conductive current flows through the contactors 45 and 79, and the movable main contactor 38 and the fixed main contactor 91 are contacted to form a conductive path.

At this time, since an impedance value of the magnetic coil 83 is relatively small compared to that of the fixed arc contactor member 77 (that is, since the conductivity of the magnetic coil 83 is greater than that of the fixed arc contactor member 77), the main conductive current flows toward the magnetic coil 83 through the movable main contactor 38 and the fixed main contactor 91, and a current as small as a predetermined ratio flows through the movable arc contactor 45 and the fixed arc contact point 79.

Preferably, the current amount flowing to the magnetic coil 83 and that of the fixed arc contactor 79 are in the ratio of 65% and 35%.

Resultantly, since the conductive current from the movable electrode 31 can be divided to flow to both the magnetic coil 83 and the fixed arc contactor 79, the conduction capacity can be increased without having a large size of magnetic coil 83.

When an abnormal current or an over-current is conducted in a state that the breaker is in an ON state, a protection controller (not shown) of the breaker is operated to transmit a trip signal to the actuator(not shown), so that the actuator is operated reversely to the ON state of the breaker, and accordingly, the movable electrode 31 is lifted to be separated from the fixed electrode 51 and the circuit is broken.

That is, when the movable electrode 31 is lifted, the movable main contactor 38 is first separated from the fixed main contactor 91, and when the movable electrode 31 is more lifted, the movable arc contactor 45 and the fixed arc contactor 79 are separated, and at this time, an arc is generated between the movable arc contactor 45 and the fixed arc contactor 79.

And, when the movable arc contactor member 41 is even more lifted up and the movable arc contactor 45 comes near the arc runner 93 of the fixed main contactor, the arc is transited to an arc runner 93 at the fixed arc contactor 79.

When the movable electrode 31 keeps ascending, an arc is formed between the movable arc contactor 45 and the arc runner 93. And the arc current flows through the fixed main contactor 91, the magnetic coil 83 and the coil supporter 98 in a coil form, according to which a magnetic field is generated at the neighboring area. The arc is rotated at a high speed in the circumferential direction of the arc runner 93 and cooled by the generated magnetic field.

In the extinguishing chamber (S), as the arc is generated, the temperature goes up. Thus, the SF6 gas is thermally expanded and the internal pressure is increased.

The arc rotated at a high speed in the circumferential direction of the arc runner 93 is contacted with the $SF_6$ gas and cooled according to a heat exchange, and at the same time, the $SF_6$ gas with the increased pressure due to the rise of the temperature is exhausted outwardly through the exhaust channels 55 and 35 respectively formed at the fixed electrode body 53 and the movable electrode body 33. Thanks to this exhausted gas, the arc is accelerated to be cooled.

When the movable electrode 31 keeps ascending and the conductive current becomes almost zero, the arc is quickly converged from the arc runner 93 to the slanted arc aligning portion 75 of the arc align member 73 in the flowing direction of the $SF_6$ gas outwardly exhausted through the exhaust passage 55 of the fixed electrode body 53. Thus, the rotation and cooling is continuously performed with the influence of the residual magnetic flux induced by the arc aligning member 73, so that the arc is quickly extinguished.

At this time, the arc aligning member 73 is made of a magnetic material, so that the arc is continuously rotated by the magnetic flux according to an eddy current induced to the arc aligning member 73, thereby improving the arc extinguishing.

Figure 9:
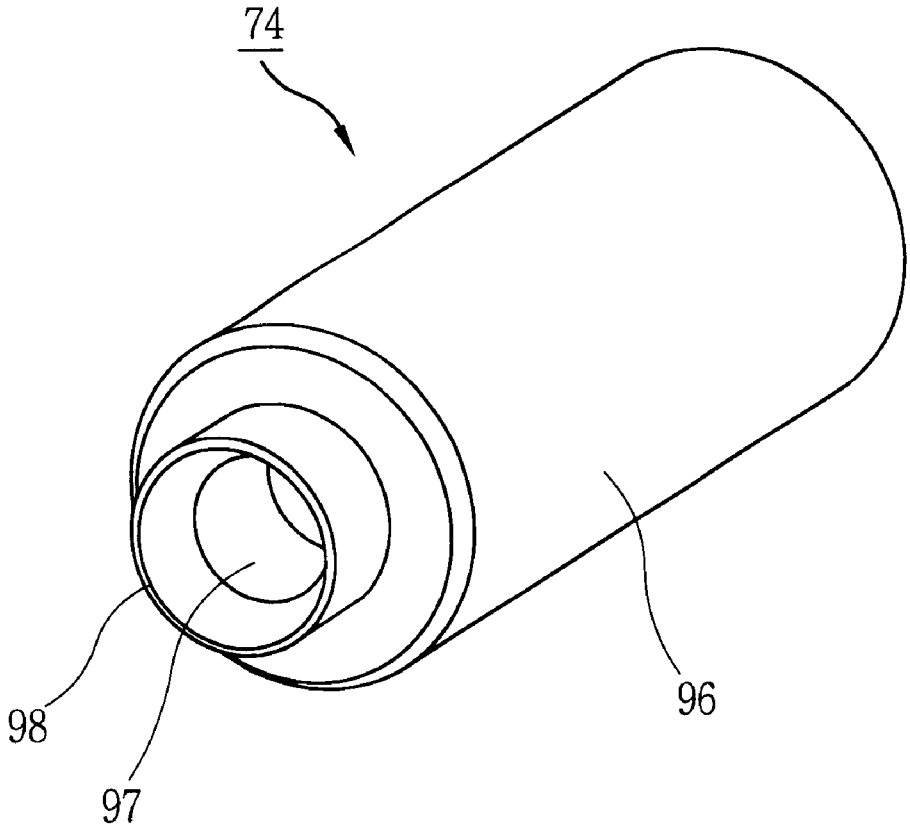
FIG. 9 is a perspective view showing an arc aligning member of a circuit breaker in accordance with another embodiment of the present invention.

FIG. 9 is a perspective view showing an arc aligning member of a circuit breaker in accordance with another embodiment of the present invention.

An arc aligning member 74 of a circuit breaker in accordance with another embodiment of the present invention includes a body portion 96, that is, a magnetic member in a hollow cylinder form with both ends in the longitudinal direction opened which is inserted into the second insertion recess of the fixed electrode body 53, a neck portion 97 extended with a reduced diameter from the upper end of the body portion 96, and an arc aligning portion 98 formed as the inner circumferential surface of the neck portion 97 is slanted inwardly.

That is, in order to quickly exhaust the arc gas, the arc aligning member 74 is formed in such a manner that the diameter of the exhaust entrance portion is smaller than that of the body portion and has the diameter which inwardly varies slantingly.

In other words, in the arc aligning member 74, when the expanded $SF_6$ gas of the extinguishing chamber is exhausted, its flowing speed becomes fast as it passes through the neck portion 97, and accordingly, the arc quickly passes in the arc aligning member 74 along with the exhausted $SF_6$ gas and quickly extinguished.

As so far described, the circuit breaker having the hybrid arc-extinguishing function has many advantages.

That is, for example, first, the arc aligning member for aligning the arc to the central portion of the fixed electrode 31 and quickly exchanging the arc is installed at the inner side of the fixed arc contactor member which forms the cable of the conductive current, so that, in extinguishing the arc, in a state that the conductive current becomes almost zero, the arc can be aligned to the central portion of the fixed electrode and continuously rotated and cooled, thereby improving the arc-extinguishing characteristic.

Secondly, in the conduction operation of a rated current, since the conductive current is divided to flow both to the fixed arc contactor and the magnetic coil, the rated current conduction capacity can be increased even without making the size of the magnetic coil to be the same. Accordingly, the size of the magnetic coil can be relatively reduced.

Thirdly, the fixed arc contactor member itself can apply an elasticity to the movable arc contactor member. Accordingly, when the movable arc contactor member is inserted into the fixed arc contactor member and electrically connected to each other, a contact force can be maintained between the fixed arc contactor member and the movable arc contactor member without any additional component for restraining an electromagnetic repulsive force. Thus, the structure can be simplified and compact.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A circuit breaker having a hybrid arc-extinguishing function comprising:

an upper shell;

a lower shell coupled to the upper shell to form an extinguishing chamber (S) filled with an insulation gas;

a movable electrode movably installed at the upper shell and having an exhaust channel for discharging a gas inside the extinguishing chamber (S) outwardly;

a fixed electrode having an exhaust channel fixed at the lower shell and positioned at a coaxial line with the movable electrode, through which the gas inside the extinguishing chamber (S) is discharged outwardly, the movable electrode being movable to a position where it contacts with the fixed electrode and to a position where it is separated from the fixed electrode;

a magnetic coil arranged around the fixed electrode to form a magnetic field for a rotation of an arc, and receiving a conductive current from the movable electrode as being shared with the fixed electrode when the movable electrode is positioned contacting with the fixed electrode; and an arc aligning member disposed at the exhaust channel of the fixed electrode to align an arc to a central portion of the fixed electrode to extinguish the arc, and the arc aligning member comprising a cylindrical magnetic material, the cylindrical magnetic material having a varying inner diameter to quickly extinguish the arc, wherein the arc aligning member has a hollow cylinder form which is inserted into the exhaust channel of the fixed electrode to discharge the gas of the extinguishing chamber outwardly, and includes an arc aligning portion with an upper inner circumferential surface formed to be slanted at a predetermined angle toward a center of an inner diameter to converge the arc.

2. The circuit breaker of claim 1, wherein the upper shell and the lower shell are mutually coupled to form a rectangular extinguishing chamber (S), partitions are formed to divide the extinguishing chamber (S) into three portions corresponding to each of three phases electric current therein, a guide sleeve at which the movable electrode is slidably disposed is integrally formed at the upper face of the upper shell, and a fixing hole is formed at the lower face of the lower shell, through which the fixed electrode penetratingly fixed.

3. The circuit breaker of claim 1, wherein the arc aligning member comprises:

a cylindrical body portion inserted into the exhaust channel of the fixed electrode;

a neck portion extended with a reduced diameter from the upper end of the body portion; and an arc aligning portion formed in a manner that the inner circumferential surface of the neck portion is slanted inwardly.

4. The circuit breaker of claim 1, wherein the fixed electrode includes a cylindrical fixed contactor for receiving a conductive current from the movable electrode, wherein the conductive current is divided to be shared with the magnetic coil in a predetermined ratio at a position where the movable electrode is inserted into the fixed electrode.

5. A circuit breaker having a hybrid arc-extinguishing function comprises:

an upper shell;

a lower shell coupled to the upper shell to form an extinguishing chamber (S) filled with an insulation gas;

a movable electrode movably installed at the upper shell, and having a movable arc contactor and a movable main contactor so that a conductive current can be divided to be shared in a certain ratio and flow through the movable arc contactor and the movable main contactor, wherein the movable electrode comprises a movable electrode body slidably inserted in a vertical direction into the upper shell, a movable arc contactor member coupled to the lower end of the movable electrode body and contacted with the fixed arc contactor member to form a conduction path, and a stopper extended outwardly from one side of the movable electrode body to restrict a vertical stroke of the movable body and having a movable main contactor with the fixed main contactor to serve as a conduction path at a lower face;

a fixed electrode fixed at the lower shell and positioned at a coaxial line with the movable electrode, and having a fixed arc contactor contacted with the movable arc contactor for forming a conduction path and a fixed main contactor contacted with the movable main contactor for forming a conduction path, the movable main contactor being movable to a position where it is contacted with the fixed main contactor and to a position where it is separated from the fixed main contactor, and the movable arc contactor being movable to a position where it is contacted with the fixed arc contactor and to a position where it is separated from the fixed arc contactor; and a magnetic coil inserted in the extinguishing chamber (S) to form a magnetic field for rotation of an arc, and receiving the part of the conductive current from the movable electrode shared with the fixed arc contactor.

6. The circuit breaker of claim 5, wherein the movable arc contactor member is integrally coupled at the lower end of the movable electrode body, and the movable arc contactor is formed with an end portion being round at an outer circumferential surface of which a conductive current flows.

7. The circuit breaker of claim 5, wherein the stopper includes an engaging seat engaged with the upper shell at an upper surface for limiting an up stroke of the movable electrode, and a movable main contactor for limiting a down stroke of the movable electrode, and being contacted with the fixed main contactor of the fixed electrode so as for the conductive current to flow.

8. The circuit breaker of claim 5, wherein the fixed electrode comprises:

a fixed electrode body fixed at the fixing hole of the lower shell and having an exhaust channel therein;

a fixed arc contactor member fixed at the exhaust path of the fixed electrode body and contacted with the movable arc contactor member to form a main conduction path; and a fixed main contactor fixed at the upper face of the magnetic coil and contacted with the movable main contactor so as for the conductive current to flow toward the magnetic coil.

9. The circuit breaker of claim 8, wherein the fixed arc contactor member has a hollow cylinder form to be inserted into the fixed electrode body and includes an elasticity providing portion for applying an elastic force in the vertical direction to the axis so that a contact pressure is applied when the movable electrode is contacted and the movable electrode is prevented from releasing by an electromagnetic repulsive force, and a fixed arc contactor formed at the upper end with which the movable arc contactor contacts.

10. The circuit breaker of claim 9, wherein the elasticity providing portion comprises:

a plurality of slits formed in the longitudinal direction to the fixed arc contactor member to provide an elastic force and a plurality of fingers formed by the slits.

11. The circuit breaker of claim 8 or 9, wherein the fixed arc contactor member is made of chrome copper.

12. The circuit breaker of claim 8, wherein the fixed main contactor is an annular conductive member which is electrically connected to the upper portion of the magnetic coil and conducted by being contacted with the movable main contactor, on which slits are radially formed at regular intervals for a prompt separation from the movable main contactor when the circuit is broken.

13. The circuit breaker of claim 8 or 12, wherein the fixed main contactor includes an arc runner formed at its inner circumferential surface, for guiding an arc.

14. The circuit breaker of claim 8, wherein the magnetic coil comprises:

a plurality of magnetic coils having annular shape stacked around the outer circumference of the fixed arc contactor member;

an electrically insulating material disposed between each pair of the magnetic coils; and a coil supporter being installed for electrically connecting each pair of the magnetic coils.

15. A circuit breaker having a hybrid arc-extinguishing function comprises:

an upper shell;

a lower shell coupled to the upper shell to from an extinguishing chamber (S) filled with a insulation gas;

a movable electrode movably disposed at the upper shell and having a movable arc contactor and a movable main contactor so that a conductive current can be divided in a certain ratio and flow through the movable arc contactor and the movable main contactor;

a fixed electrode fixed at the lower shell and positioned at a coaxial line with the movable electrode, and having a fixed arc contactor contacted with the movable arc contactor to form a conduction path and a fixed main contactor contacted with the movable main contactor to form a conduction path, the movable main contactor being movable to a position where it is contacted with the fixed main contactor and to a position where it is separated from the fixed main contactor, and the movable arc contactor being movable to a position where it is contacted with the fixed arc contactor and to a position where it is separated from the fixed arc contactor;

a magnetic coil inserted in the extinguishing chamber (S) to form a magnetic filed for a rotation of an arc, and receiving the conductive current from the movable electrode shared with the fixed arc contactor; and a cylindrical magnetic chamber with a varying inner diameter being disposed at the inner circumferential surface of the fixed electrode to align the arc to the central portion of the fixed electrode and quickly extinguish the arc in arc extinguishing, wherein the cylindrical magnetic chamber has a hollow cylinder form which is inserted into an exhaust channel of the fixed electrode to discharge the gas of the extinguishing chamber outwardly, and includes an arc aligning portion with an upper inner circumferential surface formed to be slanted at a predetermined angle toward a center of an inner diameter to converge the arc.

16. The circuit breaker of claim 15, wherein the exhaust path of the fixed electrode includes a first and a second insertion recesses with an increasing inner diameter in a step form so that the movable arc contactor member and the arc aligning member can be mounted.

* * * * *